US008104926B2

(12) United States Patent
Wang et al.

(10) Patent No.: US 8,104,926 B2
(45) Date of Patent: Jan. 31, 2012

(54) SEALED LED LAMP ASSEMBLY HAVING GAS VALVE

(75) Inventors: Zhong-Qing Wang, Shenzhen (CN); Li He, Shenzhen (CN)

(73) Assignees: Fu Zhun Precision Industry Co., Ltd., Shenzhen, Guangdong Province (CN); Foxconn Technology Co., Ltd., New Taipei (TW)

( * ) Notice: Subject to any disclaimer, the term of this patent is extended or adjusted under 35 U.S.C. 154(b) by 393 days.

(21) Appl. No.: 12/463,347

(22) Filed: May 8, 2009

(65) Prior Publication Data

US 2010/0135019 A1 Jun. 3, 2010

(30) Foreign Application Priority Data

Dec. 3, 2008 (CN) ..... 2008 1 0305935

(51) Int. Cl.
*F21V 31/04* (2006.01)

(52) U.S. Cl. ..... 362/267; 362/158; 362/249.06; 362/294; 362/373; 362/240

(58) Field of Classification Search ..... 362/545, 362/547, 96, 97.3, 158, 240, 249.02, 249.06, 362/267, 294, 373
See application file for complete search history.

(56) References Cited

U.S. PATENT DOCUMENTS

| | | | | |
|---|---|---|---|---|
| 4,733,335 | A * | 3/1988 | Serizawa et al. | 362/503 |
| 6,013,985 | A * | 1/2000 | Green et al. | 362/183 |
| 6,045,240 | A * | 4/2000 | Hochstein | 362/294 |
| 7,338,186 | B1 * | 3/2008 | Wu et al. | 362/294 |
| 7,654,701 | B2 * | 2/2010 | Zhang et al. | 362/294 |
| 7,682,055 | B2 * | 3/2010 | Shuai et al. | 362/373 |
| 7,832,899 | B2 * | 11/2010 | Zheng | 362/249.02 |
| 2003/0156416 | A1 * | 8/2003 | Stopa et al. | 362/294 |
| 2004/0233671 | A1 * | 11/2004 | Staufert | 362/294 |
| 2009/0244895 | A1 * | 10/2009 | Chen | 362/249.02 |
| 2009/0303717 | A1 * | 12/2009 | Long et al. | 362/249.02 |

* cited by examiner

*Primary Examiner* — Ismael Negron

(74) *Attorney, Agent, or Firm* — Altis Law Group, Inc.

(57) ABSTRACT

An LED lamp assembly includes a bracket, a heat sink secured on the bracket, a plurality of LED modules mounted on a bottom of the heat sink, and a transparent envelope correspondingly covering the LED modules. A sealing chamber is cooperatively defined by the heat sink, the bracket and the envelope, and the LED modules are received in the sealing chamber. The LED assembly is further provided with a gas-injecting member for injecting a predetermined gas into the sealing chamber of the LED lamp assembly therethrough.

16 Claims, 7 Drawing Sheets

SEALED LED LAMP ASSEMBLY HAVING GAS VALVE

BACKGROUND

1. Technical Field

The disclosure generally relates to LED (light emitting diode) lamps and, more particularly, to an LED lamp assembly having a gas-injecting member adapted for injecting a predetermined gas into a sealing chamber of the LED lamp assembly therethrough.

2. Description of Related Art

An LED lamp is a type of solid-state lighting that utilizes LEDs as a source of illumination. The LED lamp is intended to be a cost-effective yet high quality replacement for incandescent and fluorescent lamp due to its long-term reliability, environment friendliness, and low power consumption.

A conventional LED lamp includes a heat sink and a plurality of LED modules having LEDs attached to an outer surface of the heat sink, thereby dissipating heat generated by the LEDs via the heat sink. When the LED lamp is used for illumination, dust and moisture may enter the LED lamp, causing current leakage or short circuit, or other contamination of the LEDs. Therefore, the LED lamp is generally provided with a sealing structure to solve this problem. The sealing structure could effectively insulate an interior of the LED lamp from an outer circumstance. However, The sealing structure is still unreliable to substantially protect the interior of the LED lamp from the outside, it is more desirable to use a further means of sealing the LEDs from the outside, such as replacing original air existing in the interior of the LED lamp with a predetermined gas. Unfortunately, it is difficult for the conventional LED lamp to change the air had already existed in the interior thereof.

What is needed, therefore, is an LED lamp assembly having a gas-injecting member adapted for injecting a predetermined gas into a sealing chamber of the LED lamp assembly therethrough.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
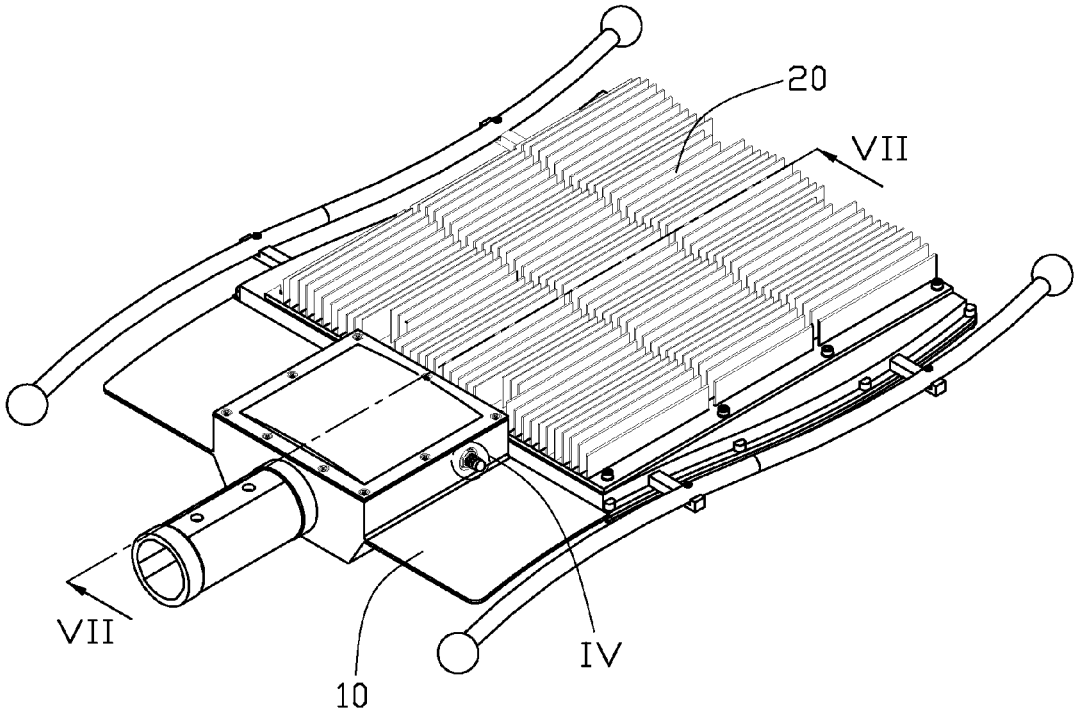
FIG. 1 is an assembled, isometric view of an LED lamp assembly in accordance with an embodiment of the disclosure.
Figure 2:
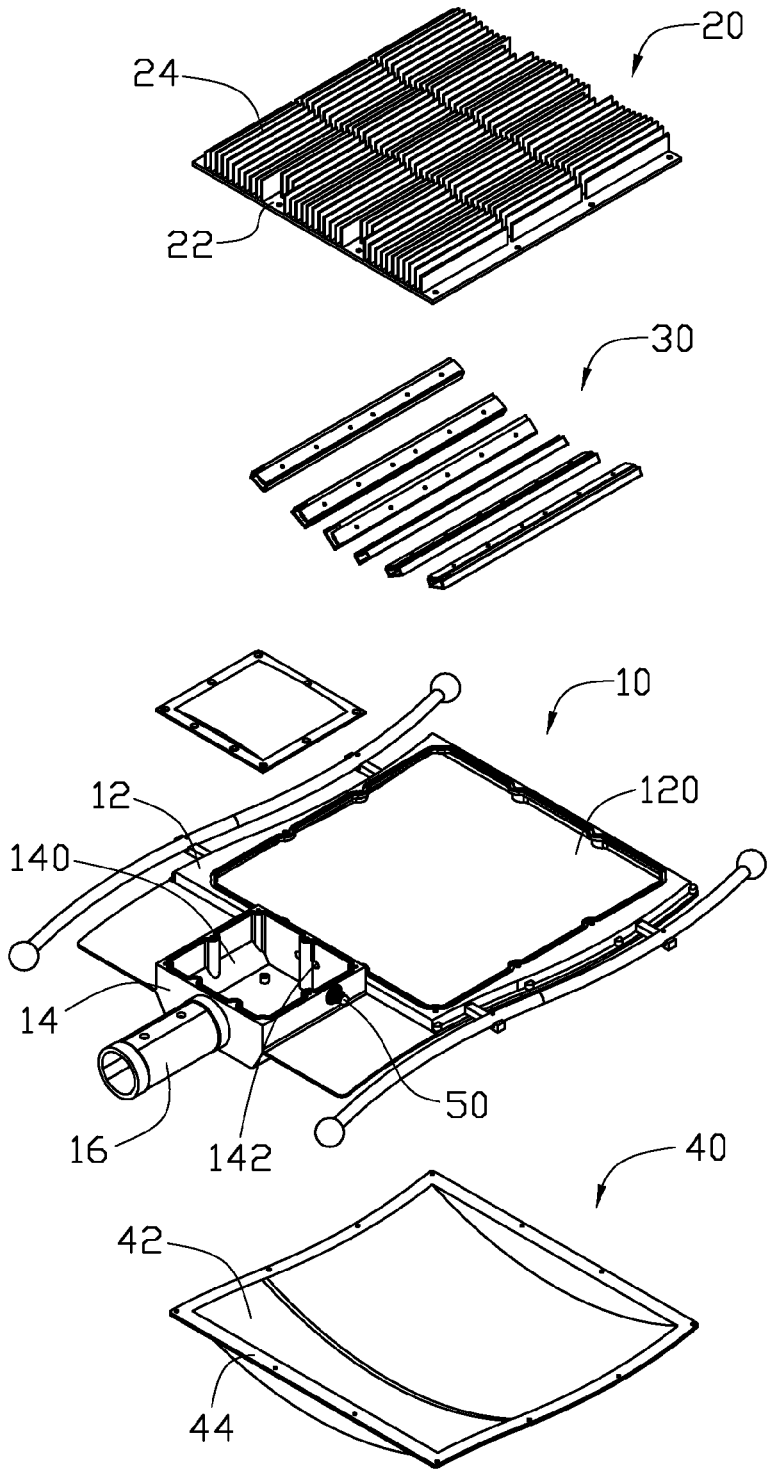
FIG. 2 is an exploded view of the LED lamp assembly of FIG. 1.

Referring to FIGS. 1-2, an LED lamp assembly in accordance with an embodiment of the disclosure having a substantially rectangular configuration comprises a bracket 10, a heat sink 20 secured on the bracket 10, a plurality of LED modules 30 mounted on a bottom of the heat sink 20, and a transparent envelope 40 hermetically engaged on a bottom of the bracket 10 and covering the LED modules 30. The LED lamp assembly further comprises a gas-injecting member 50 mounted on the bracket 10, adapted for injecting a predetermined gas into the LED lamp assembly therethrough.

Figure 3:
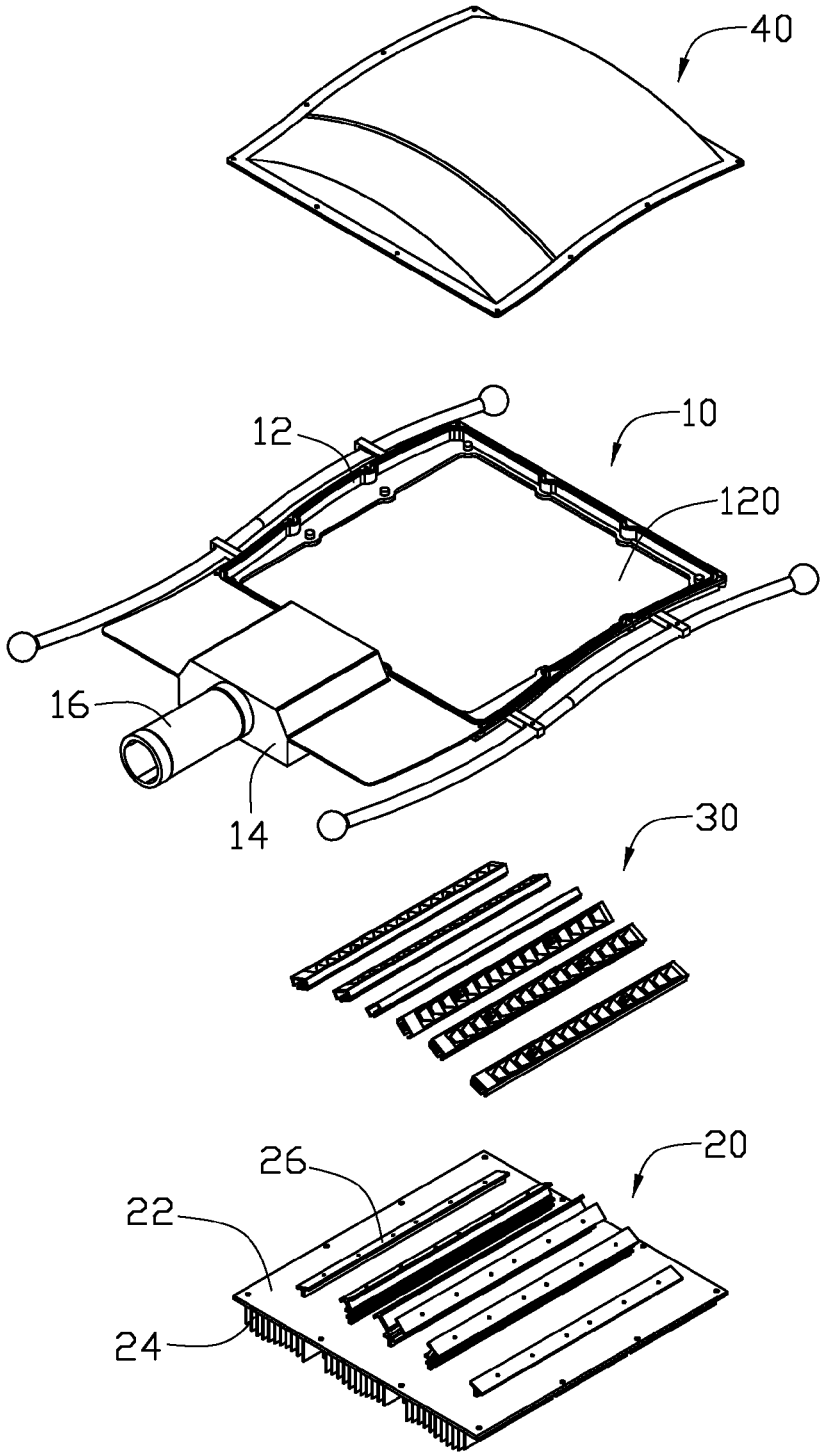
FIG. 3 is an inverted, exploded view of the LED lamp assembly of FIG. 1.
Figure 4:
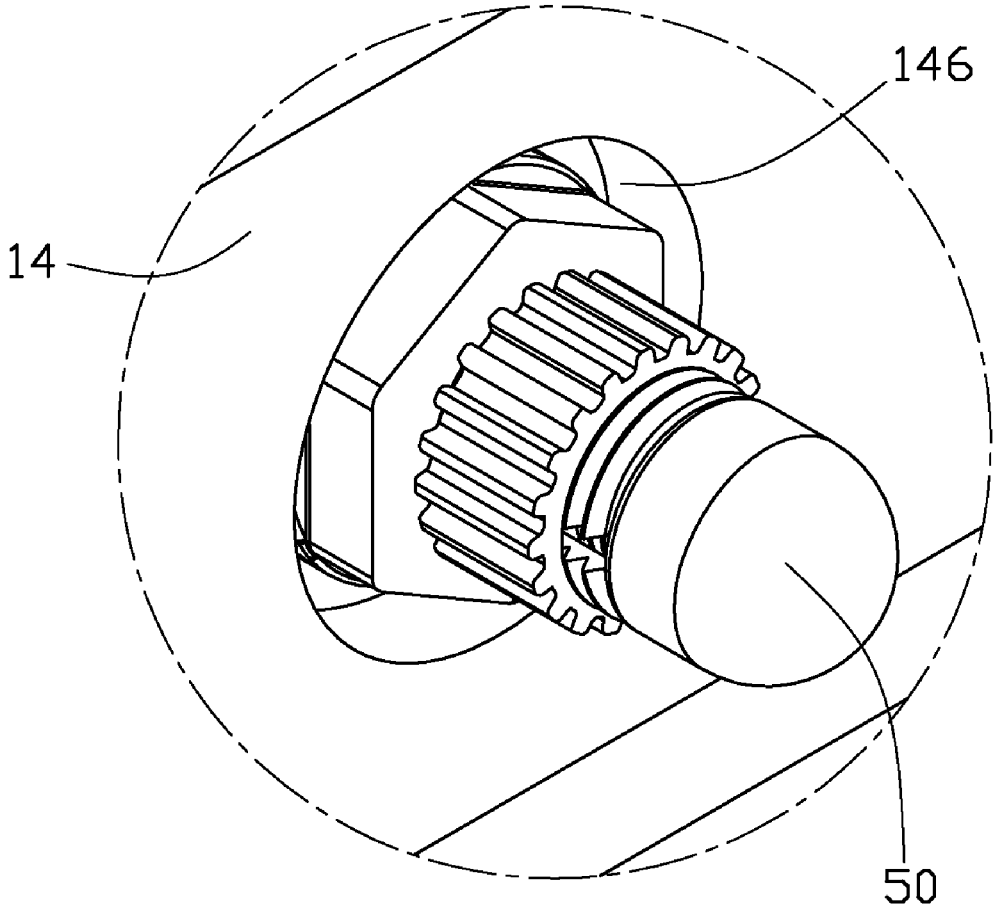
FIG. 4 is an enlarged view of part IV of the LED lamp assembly of FIG. 1.

Also referring to FIGS. 3-4, the bracket 10, integrally formed as a single piece, comprises a rectangular fixing frame 12, a cuboid driving circuit module 14 located at a rear end of the fixing frame 12 and a lamp holder 16 extending horizontally and rearwards from a central portion of a rear end of the driving circuit module 14, opposite to the fixing frame 12. The fixing frame 12 is substantially rectangular and has a rectangular opening 120 defined in a center thereof. The driving circuit module 14 defines a first receiving chamber 140 therein for receiving a driving circuit board (not shown) which electrically connects with the LED modules 30. Two spaced through holes 142 are defined in a front sidewall of the driving circuit module 14 adjacent to the fixing frame 12. The two through holes 142 extend through the fixing frame 12 and communicate the first receiving chamber 140 of the driving circuit module 14 with the opening 120 of the fixing frame 12. An engaging hole 144 is defined in a lateral sidewall of the driving circuit module 14. An outer face of the lateral side wall defines a receiving recess 146 surrounding the engaging hole 144. The lamp holder 16 connects the LED lamp assembly to a supporting structure, such as a lamp post (not shown).

The heat sink 20 is integrally formed of metal with good heat conductivity, such as aluminum, copper, or alloys thereof. The heat sink 20 comprises a rectangular base 22, a plurality of fins 24 extending upwardly from a top surface of the base 22 and a set of mounting members 26 extending downwardly and symmetrically from a bottom face of the base 22. The fins 24 are spaced from each other and extend along a length of the base 22. A passage is defined between each two adjacent fins 24 to allow airflow therethrough. The base 22 abuts against a top face of the bracket 10 around a peripheral edge of the opening 120, thereby covering the opening 120. The mounting members 26 extend downwardly through the opening 120 of the bracket 10. The mounting members 26 are parallel to and spaced from each other. Each mounting member 26 comprises a rectangular extending plate extending downwardly and perpendicularly from the bottom face of the base 22 and a rectangular mounting plate (not labeled) extending slantwise from a bottom end of the extending plate.

The LED modules 30 are thermally mounted on bottom faces of the mounting plates of the mounting members 26, respectively. Each LED module 30 comprises an elongated printed circuit board, a plurality of LEDs evenly mounted on the printed circuit board and a reflector correspondingly covering the LEDs.

The transparent envelope 40 comprises a barrel vault 42 and a mounting flange 44 extending outwardly and horizontally from a peripheral edge of the barrel vault 42. The mounting flange 44 contacts the fixing frame 12 of the bracket 10 and surrounds the opening 120 of the fixing frame 12. The barrel vault 42 is correspondingly located below the LED modules 30. The envelope 40 is made of transparent material such as plastic, glass, or other suitable material availing to transmit light.

Figure 5:
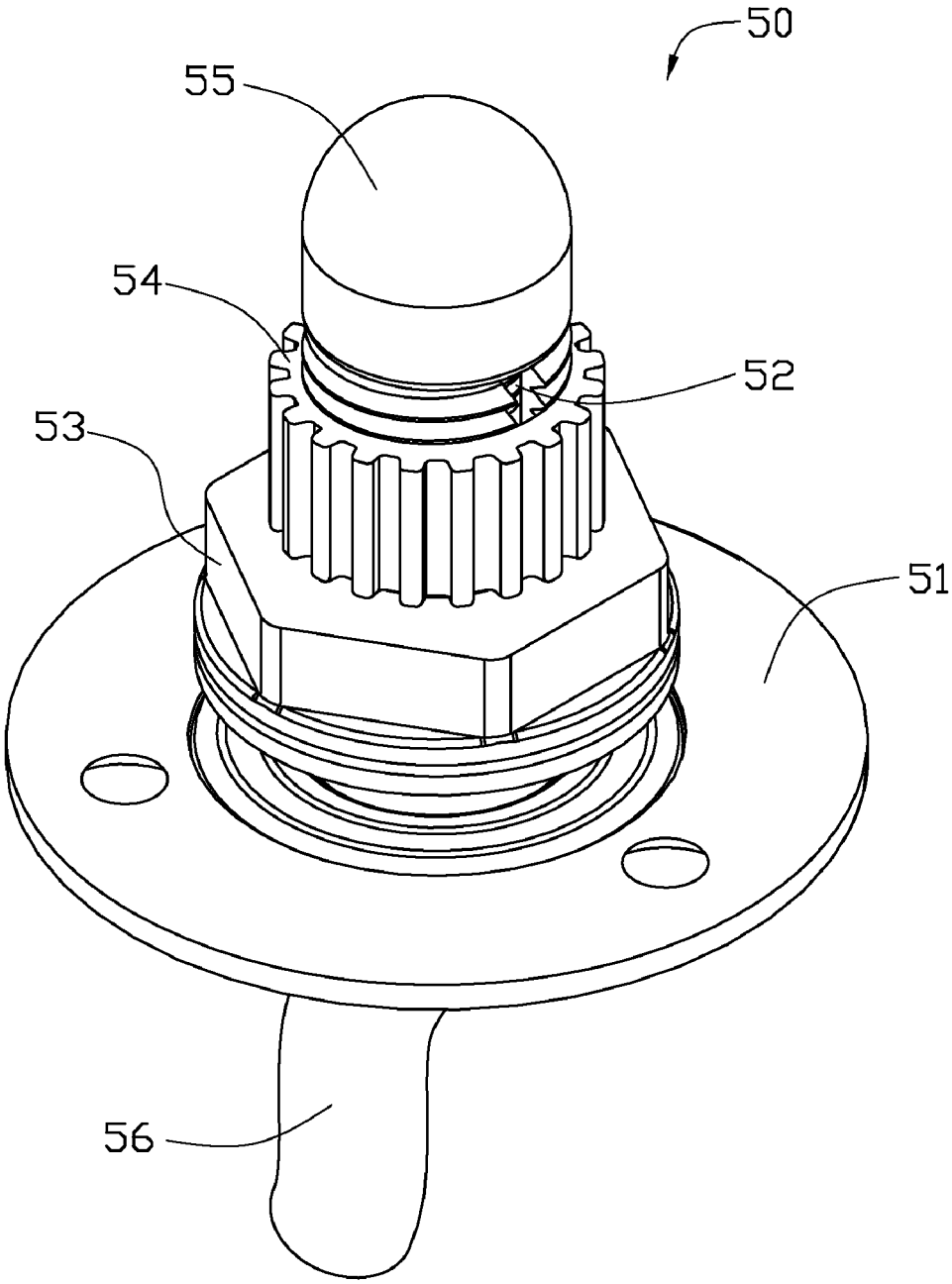
FIG. 5 is an assembled, isometric view of a gas-injecting member of the LED lamp assembly of FIG. 4, separated from a circuit driving module thereof.
Figure 6:
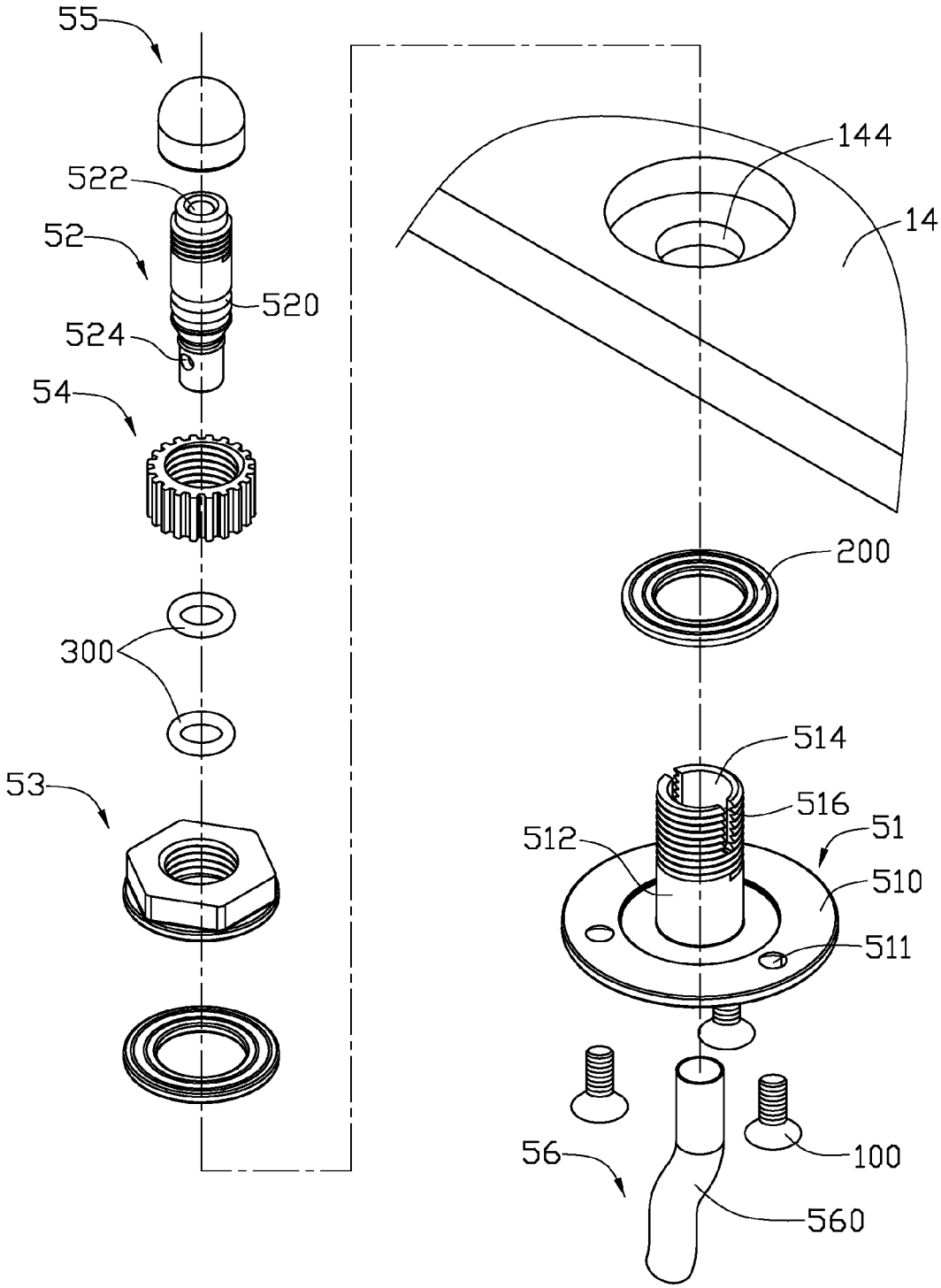
FIG. 6 is an exploded view of the gas-injecting member of FIG. 5, with the circuit driving module.
Figure 7:
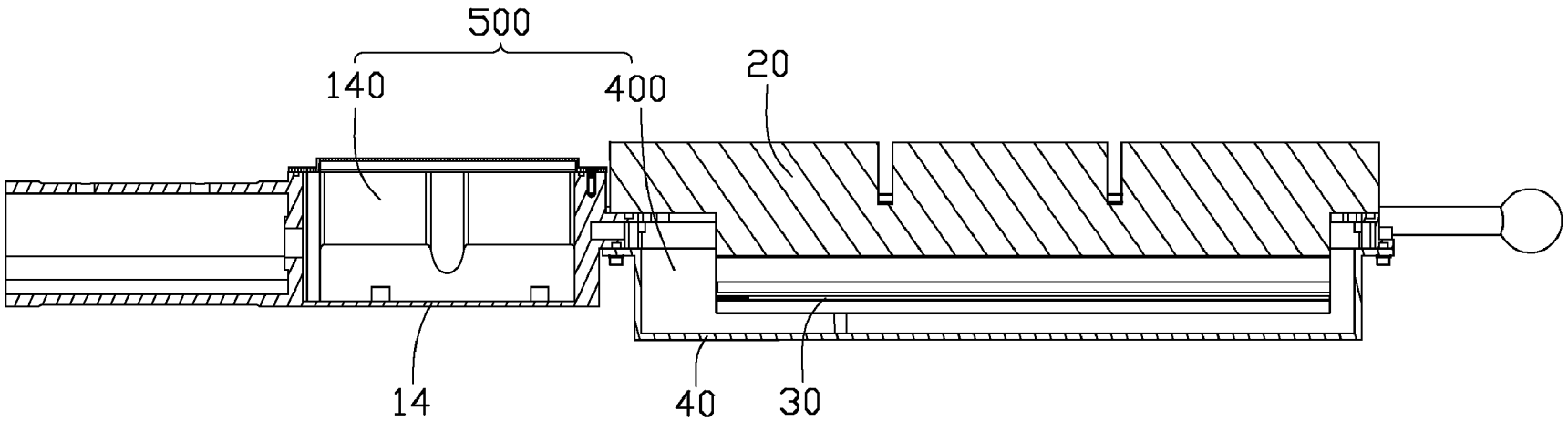
FIG. 7 is a cross-section of the LED lamp assembly of FIG. 1, taken along a line VII-VII thereof.

Referring to FIGS. 5 and 6, the gas-injecting member 50 extends through and engages in the engaging hole 144 of the driving circuit module 14 of the bracket 10, to communicate the first receiving chamber 140 of the driving circuit module 14 with an outside of the LED lamp assembly. The gas-injecting member 50 comprises a valve base 51, a valve core 52 disposed in the valve base 51, a hex nut 53 disposed around a middle portion of the valve base 51, a rim nut 54 disposed around a top portion of the valve base 51, a cap 55 disposed on a top of the valve core 52 and a hose 56 disposed at a bottom end of the valve core 52. The valve base 51 has a circular base portion 510, and a hollow tube 512 extending perpendicularly and upwardly from a top face of a center of the base portion 510. The tube 512 defines a central hole 514 extending through the tube 512 and the base portion 510. Two axial slots 516 are symmetrically defined in a top end of the tube 512. An external thread is formed on an outer surface of the tube 512. Three perforations 511 are defined through the base portion 510 and evenly distributed along a circumferential direction of the base portion 510, for allowing three screws 100 to extend through the valve base 51 to thereby mount the valve base 51 to the driving circuit module 14. The valve core 52 is substantially column shaped in profile. A diameter of a bottom portion of the valve core 52 is smaller than that of a middle portion of the valve core 52, for engaging with the hose 56. An interior of the valve core 52 forms an L-shaped air passage, wherein a top opening 522 of the air passage is formed at a center of a top end of the valve core 52, and a bottom opening 524 of the air passage is formed at a bottom of a circumference of the valve core 52. An external thread is formed at a top portion of the valve core 52, while two spaced annular indentations 520 are formed at the middle portion of the valve core 52 and parallel to each other. The hex nut 53 is screwed around a middle portion of the tube 512 of the valve base 51. The rim nut 54 is screwed around the top portion of the tube 512 of the valve base 51 and located above the hex nut 53. The cap 55 has a dome-shaped configuration, and an internal thread is formed at an inner face of the cap 55 for matching with the external thread formed on the top portion of the valve core 52. The hose 56 is made of plastic material such as rubber, and has a bended portion 560 formed at a middle thereof, for facilitating the gas injection.

Referring to FIGS. 1 through 7, in assembly of the present LED lamp assembly, a round gasket 200 is disposed around the tube 512 of the valve base 51 and contacts with a top surface of the base portion 510. The base portion 510 of the valve base 51 is disposed in the driving circuit module 14, and the tube 512 of the valve base 51 extends outwardly through the engaging hole 144 and to the outside of the LED lamp assembly. Three screws 100 respectively extend through the three perforations 511 of the base portion 510 and are screwed in the lateral sidewall of the driving circuit module 14. The round gasket 200 is sandwiched between the lateral sidewall of the driving circuit module 14 and the base portion 510. Two hermetical O-rings 300 are respectively received in the two annular indentations 520 of the valve core 52. The valve core 52 is inserted into the central hole 514 of the tube 512, with the O-rings 300 abutting against an inner surface of the tube 512 and the top end of the valve core 52 extending upwardly beyond the tube 512. The hex nut 53 is fixedly screwed around the tube 512 of the valve base 51 and received in the receiving recess of the driving circuit module 14. Another round gasket 200 is sandwiched between the hex nut 53 and the lateral sidewall of the driving circuit module 14. The rim nut 54 is screwed around the top portion of the tube 512 of the valve base 51, urging the tube 512 to fixedly clamp the valve core 52 by narrowing the two slots 516. The cap 55 is screwed on the top end of the valve core 52 and covers the top opening 522 of the air passage of the valve core 52. The hose 56 is disposed around the bottom end of the valve core 52, and covers the bottom opening 524 of the air passage of the valve core 52. The base 22 of the heat sink 20 is mounted on a top of the fixing frame 12 of the bracket 10 and covers the opening 120 of the fixing frame 12. The envelope 40 is fixed to a bottom of the fixing frame 12 and covers the opening 120 of the fixing frame 12. The base 22 of the heat sink 20, the fixing frame 12 and the envelope 40 cooperatively form a hermetical second receiving chamber 400. The LED modules 30 are attached to the bottom face of the base 22 and received in the second receiving chamber 400. The first receiving chamber 140 of the driving circuit module 14 is communicated with the second receiving chamber 400 by the two through holes 142 of the driving circuit module 14, thereby the first and second receiving chamber 140, 400 cooperatively forming a sealing chamber 500 in the LED lamp assembly.

Since the gas-injecting member 50 is fixed on the driving circuit module 14 and communicates with an interior of the LED lamp assembly, a predetermined gas, such as inert gas, could be injected into the sealing chamber 500 of the LED lamp assembly through the gas-injecting member 50, thereby protecting the LEDs from the outside of the LED lamp assembly. Additionally, a gas-leaking structure (not shown) could be further provided to the LED lamp assembly, whereby the originally existed air in the interior of the LED lamp assembly could be replaced by the inert gas more conveniently.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. An LED lamp assembly comprising:

a bracket;

a heat sink secured to the bracket;

a plurality of LED modules attached to a bottom of the heat sink;

an envelope covering the LED modules;

a sealing chamber cooperatively defined by the heat sink, the bracket and the envelope, and the LED modules being received in the sealing chamber; and a gas valve provided to the LED lamp assembly for injecting a protecting gas into the sealing chamber therethrough;

wherein the gas valve communicates the sealing chamber with an outside of the LED assembly, comprising a valve base, a valve core disposed in the valve base, a hex nut disposed around a middle portion of the valve base, a rim nut disposed around a top portion of the valve base, a cap disposed on a top end of the valve core and a hose disposed at a bottom end of the valve core.

2. The LED lamp assembly as claimed in claim 1, wherein the bracket comprises a fixing frame which defines an opening at a center thereof, the heat sink and the envelope cooperating with the opening to form a first receiving chamber receiving the LED modules therein, the first receiving chamber being a part of the sealing chamber.

3. The LED lamp assembly as claimed in claim 1, wherein the rim nut is screwed around the top portion of the tube of the valve base and urges the tube to clamp the valve core received therein.

4. The LED lamp assembly as claimed in claim 1, wherein the hose is made of plastic material and has a bended portion formed at a middle thereof.

5. The LED lamp assembly as claimed in claim 1, wherein the hex nut is screwed around the tube of the valve base and abuts against the bracket.

6. The LED lamp assembly as claimed in claim 2, wherein the heat sink comprises a base and a plurality of fins extending upwardly from a top face of the base, and the base is disposed on a top of the fixing frame and correspondingly covers the opening of the bracket.

7. The LED lamp assembly as claimed in claim 2, wherein the envelope is fixed to a bottom of the fixing frame and correspondingly covering the opening.

8. The LED lamp assembly as claimed in claim 2, wherein the bracket further comprises a driving circuit module located at a rear end of the fixing frame, the driving circuit module defining a second receiving chamber therein, the second receiving chamber being a part of the sealing chamber and communicating with the first receiving chamber.

9. The LED lamp assembly as claimed in claim 8, wherein a plurality through holes are defined in the driving circuit module and communicate the first receiving chamber with the second receiving chamber.

10. The LED lamp assembly as claimed in claim 8, wherein the gas valve is fixed on the driving circuit module and communicates the second receiving chamber with an outside of the LED lamp assembly.

11. The LED lamp assembly as claimed in claim 1, wherein the valve base has a planar base portion disposed in the sealing chamber, and a hollow tube extending upwardly from a center of the base portion and defining a central hole extending through the tube and the base portion, and the tube of the valve base extends outwardly through an engaging hole in the driving circuit module and to the outside of the LED lamp assembly.

12. The LED lamp assembly as claimed in claim 11, wherein a plurality of axial slots are defined in a top end of the tube.

13. The LED lamp assembly as claimed in claim 11, wherein the valve core is inserted into the central hole of the tube with the top end of the valve core extending upwardly beyond a top end of the tube.

14. The LED lamp assembly as claimed in claim 13, wherein a plurality of hermetical rings encircle the valve core and are sandwiched between the valve core and the tube of the valve base.

15. The LED lamp assembly as claimed in claim 13, wherein an interior of the valve core defines an L-shaped air passage, and a top opening of the air passage is formed at a top end of the valve core, and an bottom opening of the air passage is formed at a bottom of a circumference of the valve core.

16. The LED lamp assembly as claimed in claim 15, wherein the cap correspondingly covers the top opening of the valve core, and the hose correspondingly covers the bottom opening of the valve core.

* * * * *